US006357366B1

(12) United States Patent
Frankenberg

(10) Patent No.: US 6,357,366 B1
(45) Date of Patent: Mar. 19, 2002

(54) RACKABLE MOLDED PALLET

(75) Inventor: Jason R. Frankenberg, Waukesha, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 09/491,144

(22) Filed: Jan. 26, 2000

Related U.S. Application Data

(60) Provisional application No. 60/118,768, filed on Feb. 5, 1999.

(51) Int. Cl.[7] ..... B65D 19/38

(52) U.S. Cl. ..... 108/57.25

(58) Field of Search ..... 108/57.25, 57.26, 108/901, 902, 56.1, 56.3

(56) References Cited

U.S. PATENT DOCUMENTS

| | | | | |
|---|---|---|---|---|
| 3,187,689 A | | 6/1965 | Hess | |
| 3,424,110 A | | 1/1969 | Toot | |
| 3,526,195 A | | 9/1970 | Maryonovich | |
| 3,680,495 A | | 8/1972 | Pike | |
| 3,691,964 A | * | 9/1972 | Larson et al. | 108/56.3 |
| 3,707,127 A | | 12/1972 | Palfey | |
| 3,736,885 A | | 6/1973 | Freund | |
| 4,051,787 A | | 10/1977 | Nishitani et al. | |
| 4,428,306 A | | 1/1984 | Dresen et al. | |
| 4,498,860 A | | 2/1985 | Gahan | |
| 4,740,150 A | | 4/1988 | Sayer | |
| 4,824,732 A | | 4/1989 | Hendry et al. | |
| 4,923,666 A | | 5/1990 | Yamazaki et al. | |
| 4,923,667 A | | 5/1990 | Sayer | |
| 5,117,762 A | | 6/1992 | Shuert | |
| 5,125,770 A | * | 6/1992 | Brandenburg | 108/57.25 |
| 5,197,396 A | | 3/1993 | Breezer et al. | |
| 5,255,613 A | | 10/1993 | Shuert | |
| 5,329,862 A | | 7/1994 | Breezer et al. | |
| 5,404,829 A | | 4/1995 | Shuert | |
| 5,483,899 A | * | 1/1996 | Christie | 108/56.3 |
| 5,549,056 A | | 8/1996 | Jordan et al. | |
| 5,596,933 A | | 1/1997 | Knight et al. | |
| 5,606,921 A | | 3/1997 | Elder et al. | |
| 5,666,886 A | | 9/1997 | Alexander et al. | |

(List continued on next page.)

FOREIGN PATENT DOCUMENTS

| | | |
|---|---|---|
| DE | 27 33456 A1 | 8/1979 |
| EP | 202 203 A | 9/1986 |
| EP | 0 754540 A2 | 1/1997 |
| JP | 20219746 A | 3/1990 |
| JP | 5-338653 | 12/1993 |

OTHER PUBLICATIONS

Article for Pultex©, "Chap. 1: Introduction to Pultrusion," 6 pp., undated.

Brochure, "Duragrid Custom Fiberglass Grids and Grating," 8 pp., Morrison Molded Fiberglass Company (1995).

*Primary Examiner*—Jose V. Chen
(74) *Attorney, Agent, or Firm*—Quarles & Brady LLP

(57) ABSTRACT

A rackable pallet having improved structural integrity without adding material to increase the pallet weight. The pallet has a deck having a top and a bottom, a number of feet are formed extending downwardly from the deck, reinforcing members inserted in the deck top, and a lid having a top and bottom joined to the deck top and enclosing the reinforcing members. Ribs define an open grid pattern in the deck and lid, and hollow channels are formed in the deck and lid, which increases the strength of the pallet, without disproportionately increasing the volume or weight of material used. The hollow channels are formed at strategic locations in the lid top and the deck bottom. Foot straps mounted to the deck feet further improve the pallet structural integrity. Each foot strap is mounted to the feet with releasable shearable fasteners to simplify foot strap replacement and minimize foot strap damage.

19 Claims, 17 Drawing Sheets

U.S. PATENT DOCUMENTS 5,736,221 A 4/1998 Hardigg et al.
5,755,162 A 5/1998 Knight et al.
5,770,237 A 6/1998 Sayer et al.
5,809,905 A 9/1998 John et al.
5,845,588 A * 12/1998 Gronnevik ..... 108/57.25 X
5,868,080 A 2/1999 Wyler et al.
5,941,179 A * 8/1999 Herring ..... 108/56.3 X
5,967,057 A 10/1999 Nakayama et al.
6,029,583 A * 2/2000 LeTrudet ..... 108/57.25
6,109,190 A * 8/2000 Hale et al. ..... 108/57.25
6,138,582 A * 10/2000 Fujii et al. ..... 108/57.25

* cited by examiner

RACKABLE MOLDED PALLET

CROSS-REFERENCE TO RELATED APPLICATIONS

This application claims the benefit of U.S. Provisional Patent Application No. 60/118,768 filed on Feb. 5, 1999.

STATEMENT REGARDING FEDERALLY SPONSORED RESEARCH OR DEVELOPMENT

Not Applicable.

FIELD OF THE INVENTION

The field of the invention is pallets, and more particularly, rackable molded plastic pallets.

BACKGROUND OF THE INVENTION

Plastic pallets are in common use in many industries. They are used as load platforms for easily transporting loads using material handling equipment, such as fork lift trucks and the like. A typical pallet has a deck with an upper surface for supporting a load and a lower surface which is engaged by the material handling equipment when in transit.

The load on a typical pallet causes the pallet deck to deflect concave upward in the areas between the feet and to compress the feet of the pallet, while lifting or transporting the pallet by engaging the material handling equipment causes the pallet deck to deflect concave downward. Constant movement of the pallet subjects a pallet deck to a continuous cycle of upward and downward deflections, weakening the pallet structure and eventually causing the pallet to fail. When the loaded pallets are stored in storage racks which have rack support arms to support the pallet sides and not the pallet center, the load on the pallet causes the pallet to deflect concave upward even further hastening the pallet's demise.

One method which prolongs the life of a plastic pallet is to add material to the structural components of the pallet increasing the pallet stiffness and capability to withstand many deflection cycles. This method, however, increases the weight and cost of the pallet. Thus, a need exists for a method of increasing the strength of material handling pallets, without significantly increasing the weight or cost.

SUMMARY OF THE INVENTION

The present invention provides a rackable pallet having improved structural integrity without adding material to increase the pallet weight. The pallet has a deck having a top and a bottom, a number of feet are formed extending downwardly from the deck, reinforcing members inserted in the deck top, and a lid having a top and bottom joined to the deck top and enclosing the reinforcing members. Ribs define an open grid pattern in the deck and lid, and hollow channels are formed in the deck and lid, which increases the strength of the pallet, without disproportionately increasing the volume or weight of material used. The hollow channels are formed at strategic locations in the lid top and the deck bottom.

Foot straps mounted to the deck feet further improve the pallet structural integrity. Each foot strap is mounted to the feet with releasable shearable fasteners to simplify foot strap replacement and minimize foot strap damage.

The foregoing and other objects and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENTS

Figure 1:
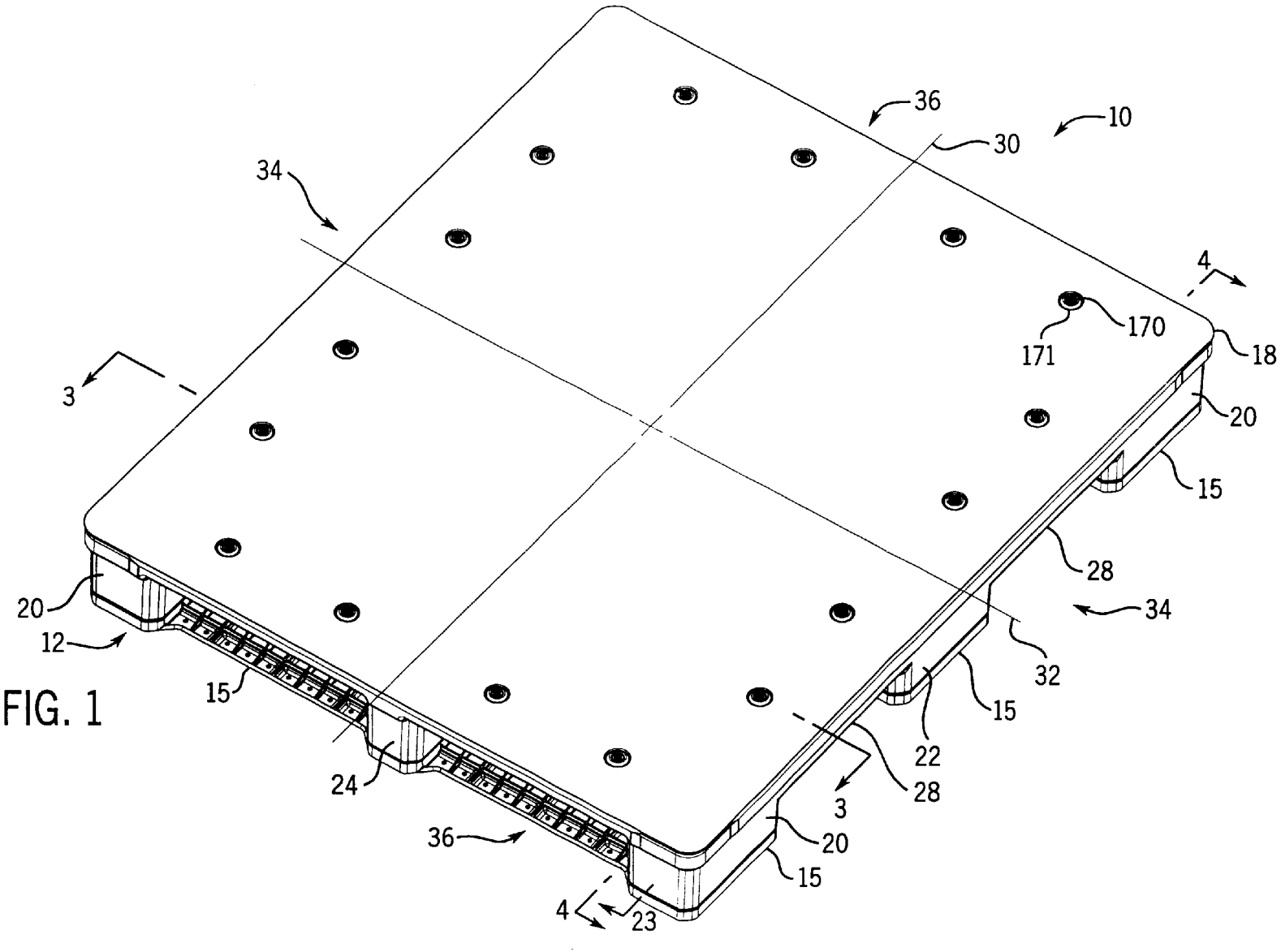
FIG. 1 is a top perspective view of a pallet incorporating the present invention.

Referring to FIGS. 1–4, a structural channel pallet 10 has a deck 12 with a top 14 and a bottom 16, reinforcing members 98, 10 inserted in the deck top 14, and a lid 18 joined to the deck top 14 enclosing the reinforcing members 98, 110. The pallet 10 is supported by a plurality of feet 20, 22, 24, 26 which are integrally formed as part of the deck bottom 16. Foot straps 15 releasably attached to the feet 20, 22, 24, 26 with fasteners 184 improves the structural integrity and maintainability of the pallet 10. Anti-skid grommets 260 mounted to the foot strap bottom 192 discourage the assembled pallet 10 from slipping on a pallet supporting surface.

A load (not shown) supported by the pallet 10 causes the deck 12 and lid 18 to deflect convex downward, increasing the tensile stress in the deck bottom 16. Conversely, the pallet 10 is lifted using material handling equipment, such as a fork lift, engaging the deck bottom 16 or fork supports 28 which deflects the deck 12 and lid 18 to take on a convex upward shape, causing tensile stress in the deck top 14 and lid 18. Hollow channels 17, 19, 21 more clearly shown in FIGS. 10 and 14, formed in the deck bottom 16, feet 20, 22, 24, 26, and lid 18 increase the structural integrity of the pallet 10 without increasing the pallet weight.

Figure 5:
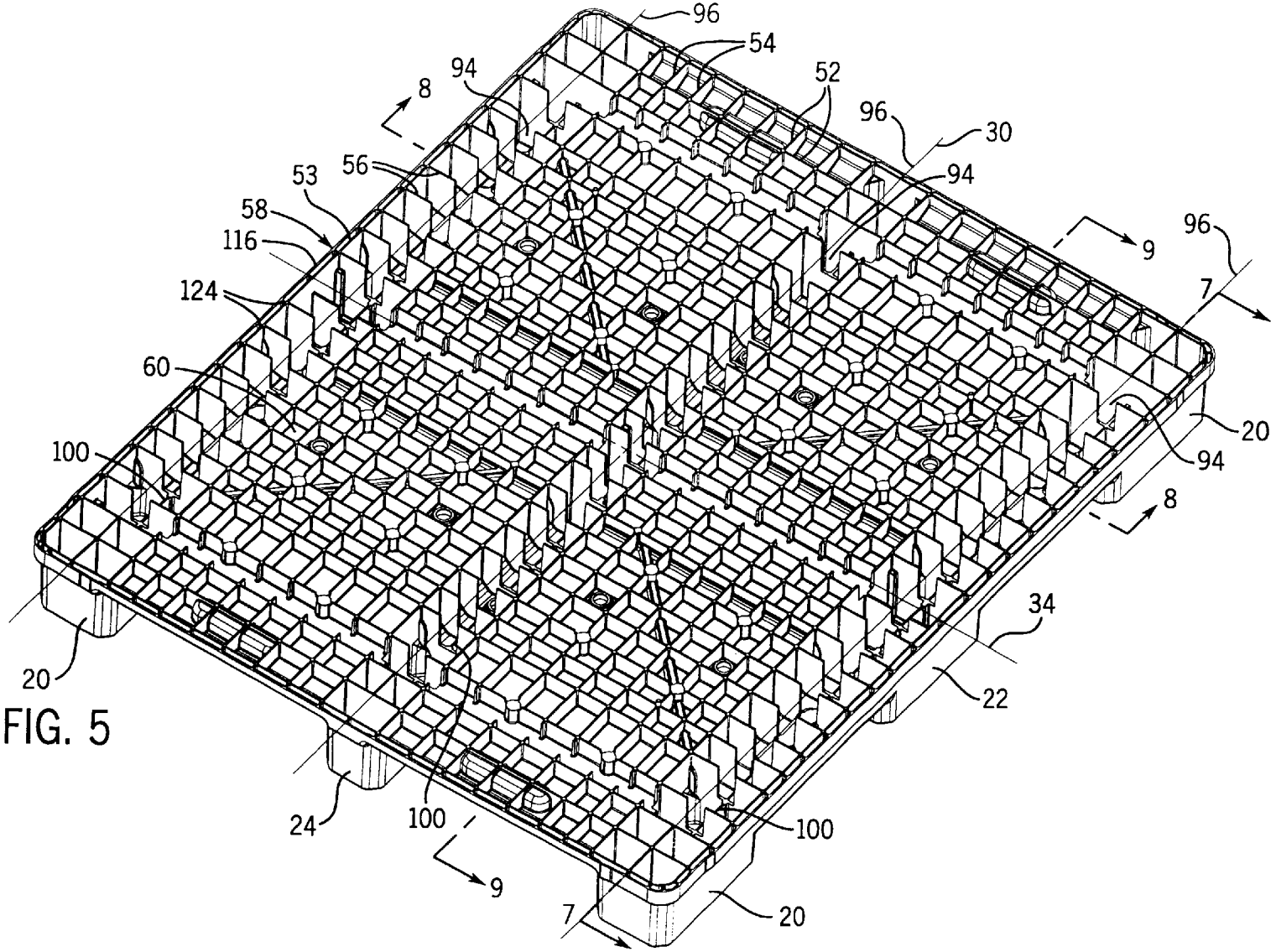
FIG. 5 is a top perspective view of the deck of the pallet of FIG. 1.

Referring to FIG. 5, the deck 12 is generally rectangular having a longitudinal axis 30, a lateral axis 32, and two opposing sides 34 joined together by two opposing ends 36. Preferably, the deck 12 is formed from a molded thermoplastic material, such as high density polyethylene, using a molding method which forms channels in the thermoplastic materials, such as the injection molding techniques described in U.S. Pat. Nos. 4,498,860; 4,740,150; 4,824,732; 4,923,666; 4,923,667; and 5,770,237, which are hereby incorporated by reference. Other methods known in the art to form hollow channels may be used, such as inserting pins in the molten material or the like, without departing from the scope of the present invention.

Figure 6:
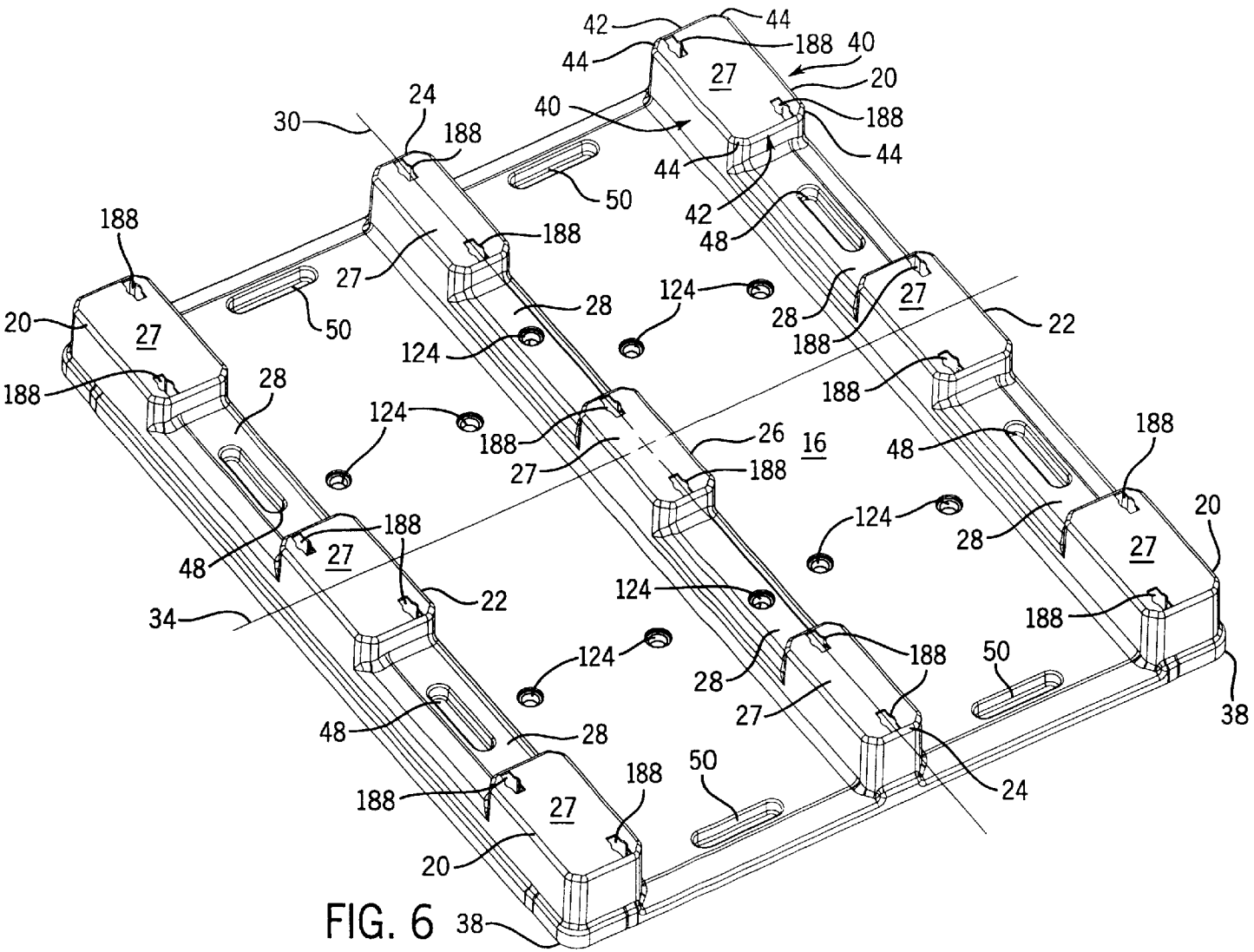
FIG. 6 is a bottom perspective view of the deck of FIG. 1.

Looking particularly at FIG. 6, the deck 12 has a total of nine feet supporting the deck 12: four corner feet 20, one at each pallet comer 38; two side feet 22, one on each pallet side 34 disposed between adjacent comer feet 20; two end feet 24, one on each pallet end 36 disposed between adjacent comer feet 20; and one center foot 26 generally located at the intersection of the longitudinal and lateral axes 30, 32. The deck feet 20, 22, 24, 26 support the pallet and are generally rectangular shaped having four sides 40, 42 and chamfered comers 44. First and second sides 40 are spaced apart and substantially parallel to the pallet longitudinal axis 30. The third and fourth sides 42 are spaced apart joining the first and second sides 40 at the chamfered comers 44. The chamfered comers 44 guide lift equipment, such as lift truck forks, between adjacent feet 20, 22, 24, 26. Fastener receptacles 188 formed in the deck feet 20, 22, 24, 26, and further described below, engage fasteners 184 for mounting the foot straps 15 thereon.

Adjacent feet 20, 22, 24, 26 aligned substantially parallel to the longitudinal axis 30 are joined by fork supports 28 extending downwardly from the pallet bottom 16. The fork supports 28 provide an engagement surface for lifting the pallet 10 with forks aligned substantially parallel with the lateral axis 32. Elongated indentations 48 formed in the fork supports 28 adjacent the pallet sides 34 form handles for manually lifting the pallet 10 at the pallet sides 34. Advantageously, elongated indentations 50 formed in the deck bottom 16 interposed between the feet 20, 24 supporting each pallet end 36 form handles for manually lifting the pallet 10 at the pallet ends 36.

Referring back to FIG. 5, the pallet deck top 12 is a grid 52 formed of a plurality of spaced ribs 54, 56 and surrounded by an edge bumper 58 integrally formed around the circumference of the grid 52. Preferably, the grid 52 is formed by a set of twenty-one longitudinal ribs 54 which are substantially parallel to the longitudinal axis 30 and a set of twenty-six lateral ribs 56 perpendicular to the longitudinal ribs 54 and substantially parallel to the lateral axis 32. The intersecting ribs 54, 56 define grid cells 60.

Figure 7:
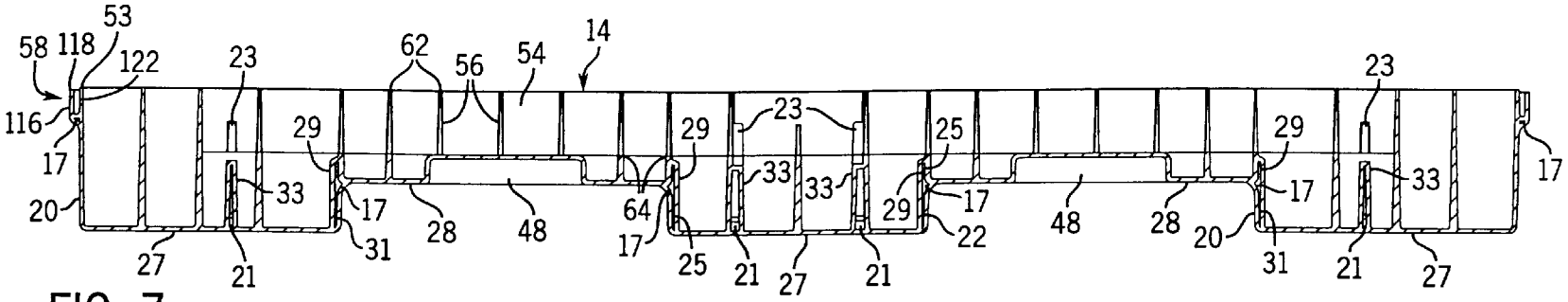
FIG. 7 is a cross sectional view along line 7—7 of FIG. 5.
Figure 8:
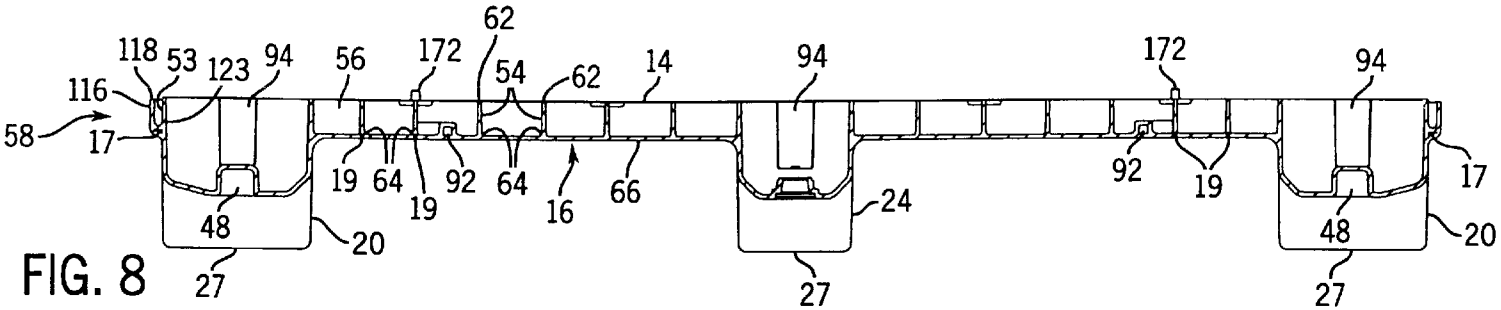
FIG. 8 is a cross sectional view along line 8—8 of FIG. 5.
Figure 9:
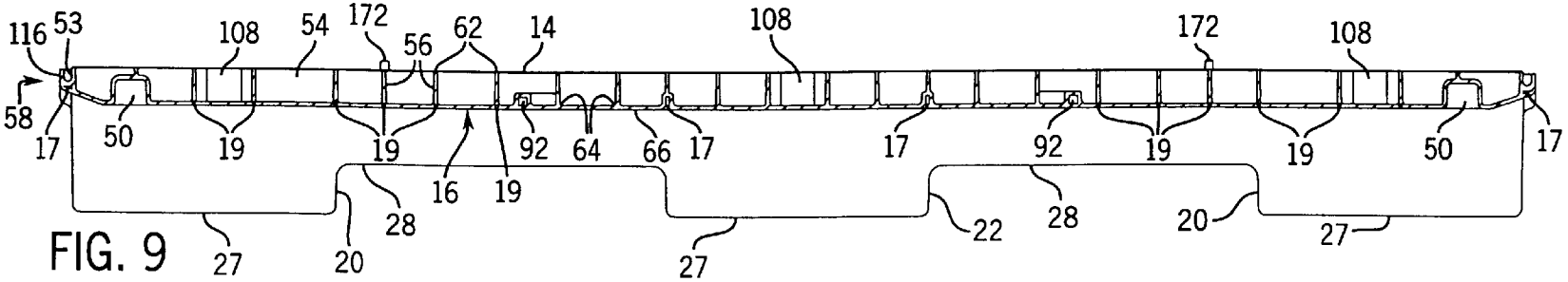
FIG. 9 is a cross sectional view along line 9—9 of FIG. 5.

Looking particularly at FIGS. 7–9, the ribs 54, 56 are substantially narrower in width than in depth having upper edges 62 and lower edges 64. The upper edges 62 are substantially coplanar and define the deck top 14. The rib lower edges 64 are substantially coplanar and joined to a skin 66 defining the deck bottom 16.

Figure 10:
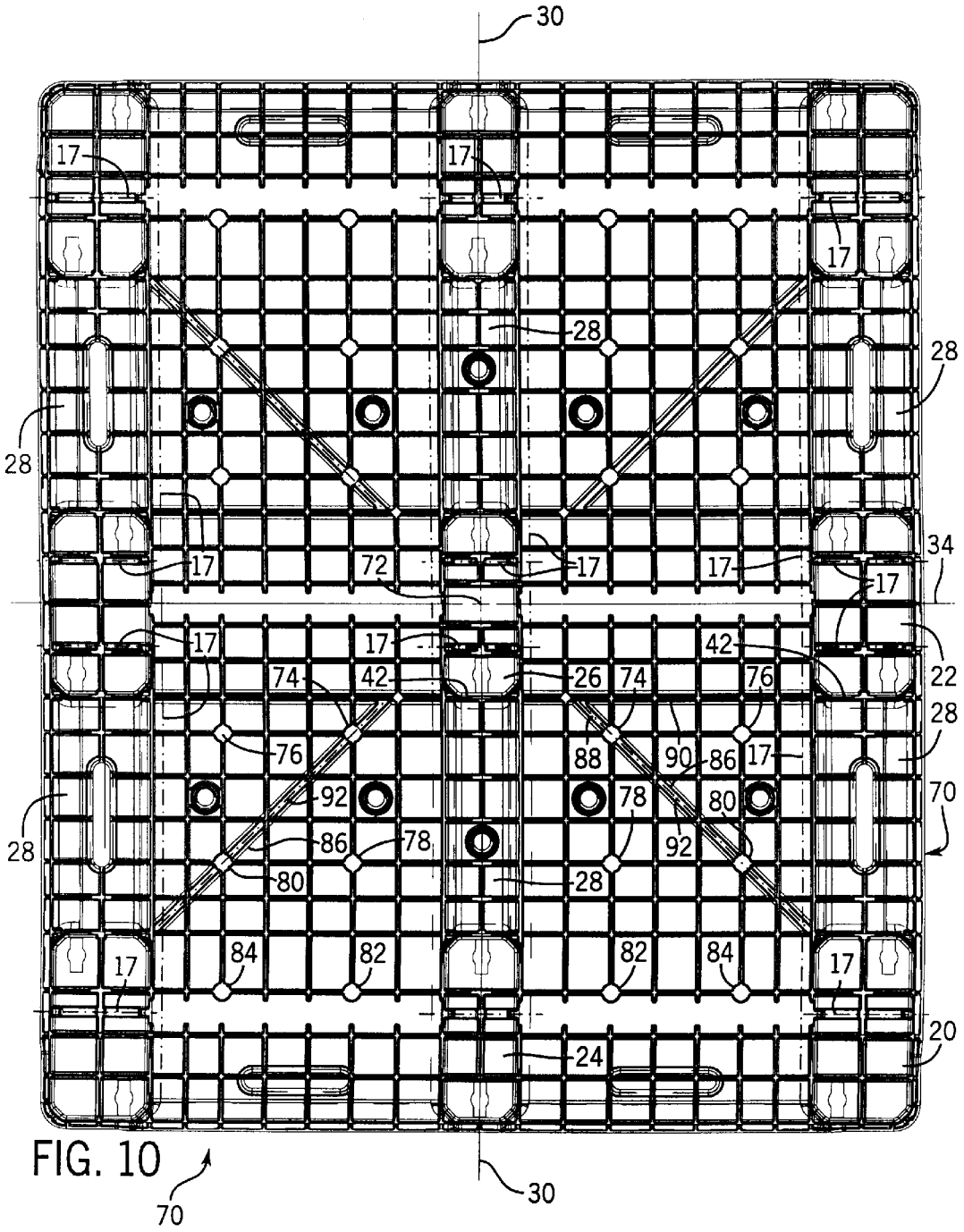
FIG. 10 is a top plan view of the deck of FIG. 5.
Figure 10A:
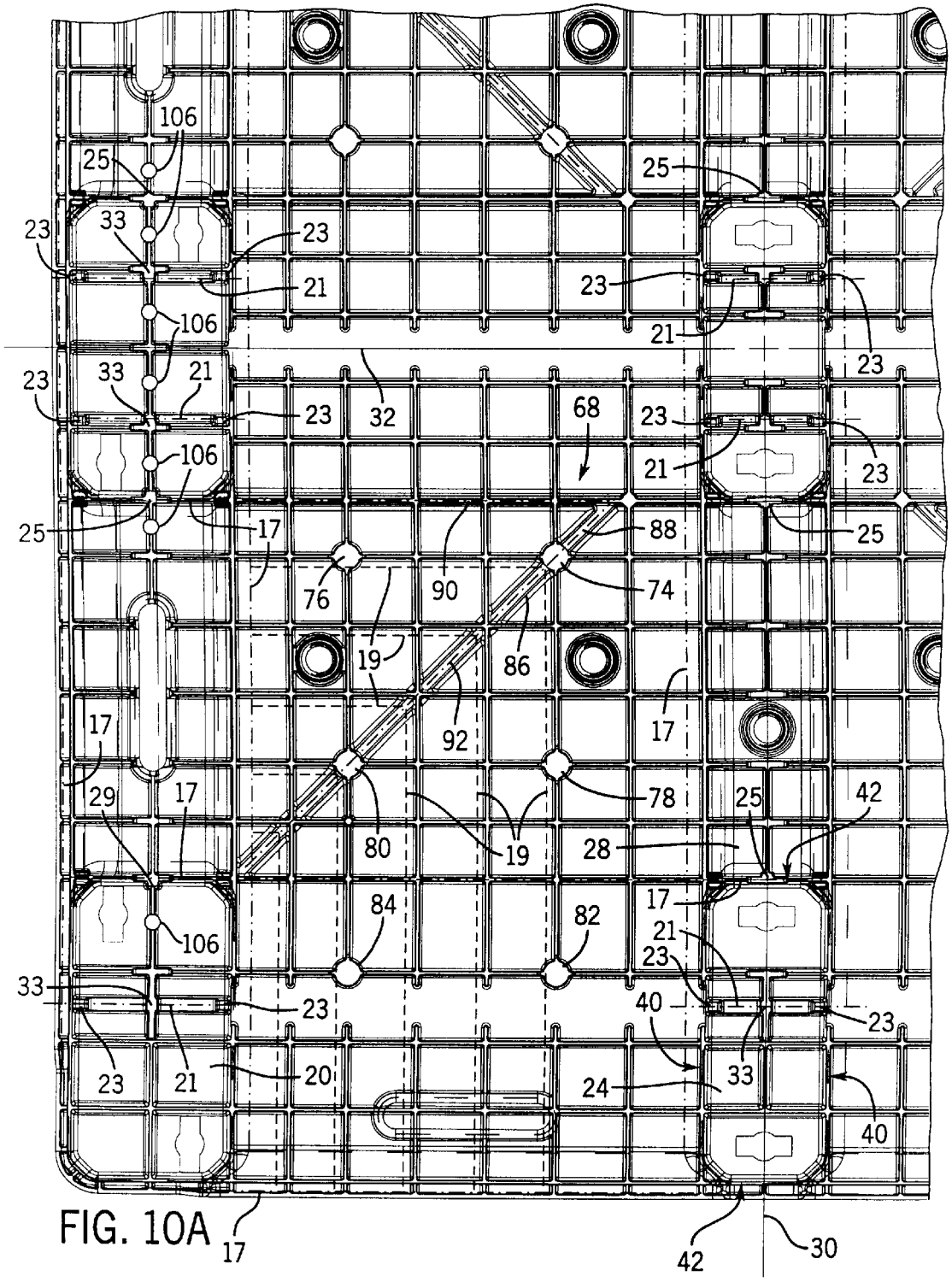
FIG. 10A is a top plan view of a quadrant of the deck of FIG. 5.

Looking particularly at FIGS. 7–10B, hollow channels 17, 19, 88, 90, 92 formed in the pallet deck bottom 16 and feet 20, 22, 24, 26, shown in FIG. 10A as dash-dot-dash and dash lines, increase the structural integrity of the pallet 10 without increasing the pallet weight. Primary channels 17 extend adjacent to and substantially parallel with the fork supports 28, into and around the feet 20, 22, 24, 26, and around the deck 12 perimeter. Additional primary channels 88, 90, 92 combine with secondary channels 17 to define a pattern 68 in pallet quadrants 70 on the deck bottom 16. The quadrants 70 are substantially identical to one another, being either the same as or mirror images of one another (diagonally opposite quadrants are the same, adjacent quadrants are mirror images of one another). Thus, the pattern 68 of channels in each quadrant 70 is identical in each of the four quadrants 70 of the deck grid 52. Each of the corner quadrants 70 is defined by the longitudinal axis 30 and lateral axis 32 intersecting at the deck center 72.

Referring particularly to FIG. 10, each quadrant 70 preferably has six gates 74, 76, 78, 80, 82, and 84 for injecting the thermoplastic material into a mold defining the deck shape. The gates 74, 76, 78, 80, 82, and 84 are spaced along the deck top 14 in a rectangular pattern ensuring an even distribution of thermoplastic material in each quadrant 70. In the preferred embodiment, one gate 74, nearest the center foot 26 and disposed along a diagonal 86 extending from the center foot 26 to the comer foot 20 in the quadrant 70, also injects gas into the thermoplastic material forming the structural channels 17, 19, 21, 25, 88, 90, and 92 such as described in U.S. Pat. Nos. 4,498,860, 4,740,150, 4,824,732, 4,923,666, 4,923,667, and 5,770,237, referred to above. The gas injecting gate 74 defines the start of the channel pattern 68 in each quadrant 70.

Each channel pattern 68 is substantially similar to the channel pattern disclosed in U.S. Patent Application Ser. No. 09/391,261 filed on Sep. 7, 1999, which is commonly owned and fully incorporated herein by reference. The pattern 68 has three primary channel legs 88, 90, 92 illustrated with dash-dot-dash lines. From the area of the gate 74, each primary channel leg 88, 90, 92 extends toward a respective foot 20, 22, or 26 at a corner of the quadrant 70. Secondary channels 19, illustrated with dashed lines branch off of the primary channel 92.

Referring to the pattern 68 of secondary and primary channels 17, 88, 90, 92, 19 indicated by dash-dot-dash and dashed lines in a single quadrant 70, as shown in FIG. 10A, a first primary channel leg 88 extends along the diagonal 86 from the gas injecting gate 74 toward the center foot 26. The channel leg 88 intersects a second primary channel 90 substantially parallel to the lateral axis 32 extending between fork supports 28 substantially aligned with a foot third side 42 joining primary channels 17 along the fork supports 28.

A third primary leg channel 92 extends from the injecting gate 74 along the diagonal 86 toward the deck corner foot 20 within the quadrant 70. Secondary channels 19 branching off of the third primary channel leg 90 extend along the longitudinal and lateral ribs 54, 56 toward the pallet side 34 and end 36. The third leg 92 intersects the primary channel 17 along the fork supports 28. The invention may be practiced without any secondary channels 19, but if they are provided, they further increase the pallet 10 strength without providing additional material which increases the pallet weight. If the gas charging method of forming the channels 17, 19 is used, the secondary channels 19 will typically be of varying length (depending on processing conditions).

Figure 10B:
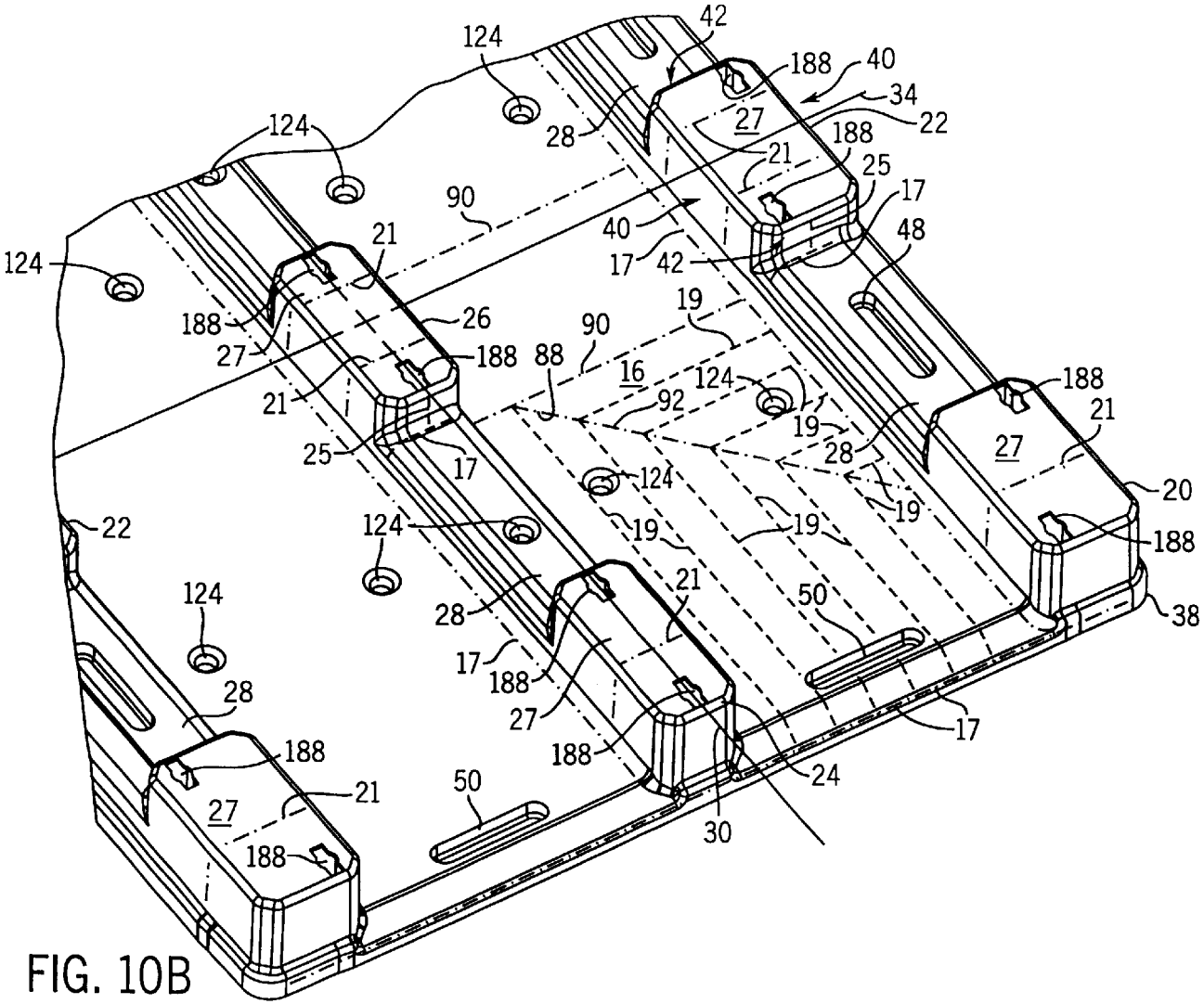
FIG. 10B is a bottom perspective view of a portion of the deck of FIG. 5.

As shown more clearly in FIGS. 10A and 10B, channels 17 surround each fork support 28 and foot 20, 22, 24, 26 to improve the pallet 10 structural integrity without increasing the weight of the pallet 10. Crossing hollow channels 21 (shown in FIG. 10B) cross through each foot 20, 22, 24, 26 by extending along a first vertical column 23 (shown in FIG. 10A) down the first foot side 40, across the foot bottom 27 and then up a second vertical column 23 formed on the opposing second foot side 40 to reunite with the channel 17 surrounding the foot 20, 22, 24, 26. The center foot 26 and each side foot 22 have a pair of crossing hollow channels 21 spaced on opposing sides of the lateral axis 32. Advantageously, the hollow vertical columns 23 enhance the compression strength of the feet 20, 22, 24, 26, and in the end and corner feet 24, 20, the columns 23 support the center and ends of each lateral reinforcing member 110. As shown most clearly in FIGS. 7 and 10A, the crossover channel 21 also extends into a third hollow vertical column 33 interposed between the first and second vertical columns 23 to support the longitudinal reinforcing members 98.

Hollow vertical channels 25 are also formed in the foot sides to support the longitudinal reinforcing members 98. As shown in FIGS. 7, 10A, and 10B, (FIG. 7 is a cross sectional view along line 7—7, which is adjacent longitudinal rib 100 of FIG. 5) the center and side feet 26, 22 have vertical channels 25 which extend from the hollow channel 17 surrounding each foot 26, 22 and down columns 27 formed on opposing third and fourth feet sides 42. The hollow columns 27 in the center and side feet 26, 22 support the center of each longitudinal reinforcing member 98. Each corner and end foot 20, 24 also have a column 29 with a hollow channel 31 which is formed on the interior facing third or fourth foot side 42. The hollow columns 29 supports each end of the longitudinal reinforcing members 98 and enhance the compression strength of the feet 20, 22, 24, 26.

Referring back to FIGS. 5 and 7–9, notches 94 formed in the lateral ribs 56 and generally centrally disposed along a longitudinal central axis 96 of each fork support 28 form three elongated recesses in the deck top 14 substantially parallel to the longitudinal axis 30. Each recess extends substantially the entire length of the pallet 10 to receive a longitudinal reinforcing member 98, such as steel tube, wood stiffener, composite stiffener, or the like. A supporting longitudinal rib 100 generally centrally disposed beneath each recess supports the reinforcing member 98 which is also retained laterally by the notch edges 102. Preferably, the reinforcing member 98 uppermost surface is substantially coplanar with the deck lower surface 16 to allow room for an overlapping lateral reinforcing member 104 interposed between the longitudinal reinforcing member 98 and the lid 18. Advantageously, ejector pin supports 106 formed in the supporting longitudinal rib 100 for ejecting the deck 12 from the mold provide additional support for the longitudinal reinforcing member 98.

Additional notches 108 formed in the longitudinal ribs 54 form three elongated recesses in the deck top substantially parallel to the lateral axis 32. Each recess extends substantially the entire width of the pallet 10 to receive a lateral reinforcing member 110, such as a steel tube, wood stiffener, composite stiffener, or the like. The lateral reinforcing member 110 is supported by the deck bottom skin 66, and a longitudinal reinforcing member 98 at the lateral member ends 112 and center 114.

Referring particularly to FIGS. 7–9, the pallet deck has an edge bumper 58 formed by an edge rib 116 spaced from the grid periphery 53 to provide improved impact strength. The edge rib 116 has a top edge 118 terminating a distance short of the deck top 14 to minimize the formation of excess material 117 (shown best in FIG. 3) on t he pallet exterior at the seam 120 between the deck 12 and lid 18 when they are joined together. An edge rib lower edge 122 is joined to the grid periphery by a skin 123 substantially coplanar with the deck bottom skin 66. Short ribs 124 substantially perpendicular to the edge rib 116 strengthens the edge bumper 58 impact strength and define the distance between the edge rib 116 and the grid 52 periphery. A hollow channel 126 formed along the edge rib lower edge 122 along the grid periphery 53 improves the structural integrity of the edge bumper 58.

Looking particularly at FIG. 6, holes 124 for securing an anti-skid rubber grommet 130 are formed in the deck bottom 16, feet 20, 22, 24, 26, and fork supports 28. Preferably, eight holes 124 are formed on the deck bottom 16 and spaced on both sides of longitudinal axis 30. Most preferably, an additional hole 124 is formed in each fork support 28 joining the end feet to the center foot. Grommets 130 provided in the deck bottom 16 and the fork supports 28 keep the pallet 10 from sliding around on top of fork lift forks. Additional smaller holes (not shown) in the deck bottom 16 corresponding to holes 170 formed in the lid 18 may be provided as drain holes for a liquid, such as water, that may enter a grid cell 60 through the lid hole 170. If the foot strap 15 is not provided, holes and grommets may also be provided in the feet bottoms 27 to prevent pallet 10 slippage.

Figure 3:
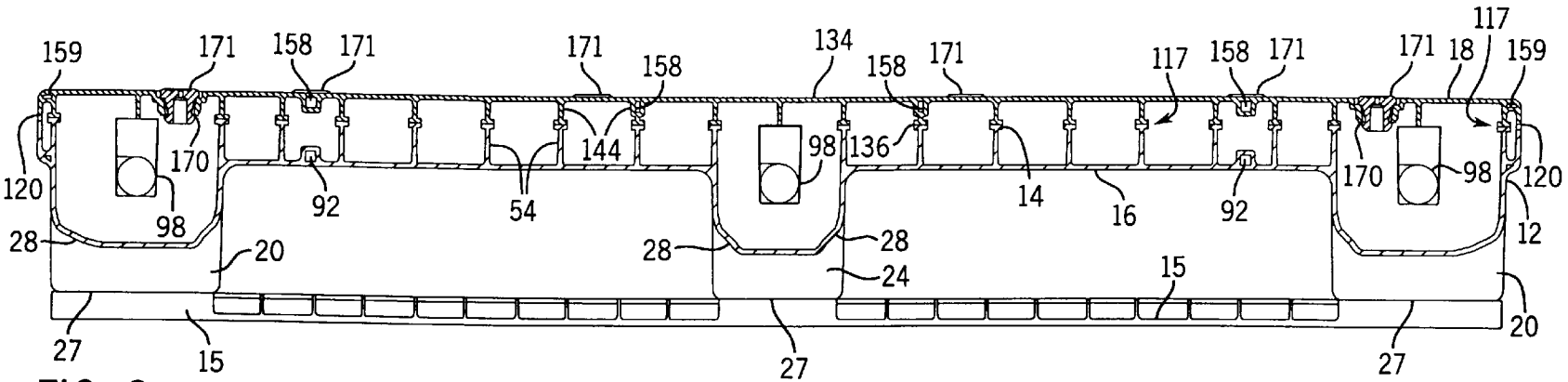
FIG. 3 is a cross sectional view along line 3—3 of FIG. 1.
Figure 4:
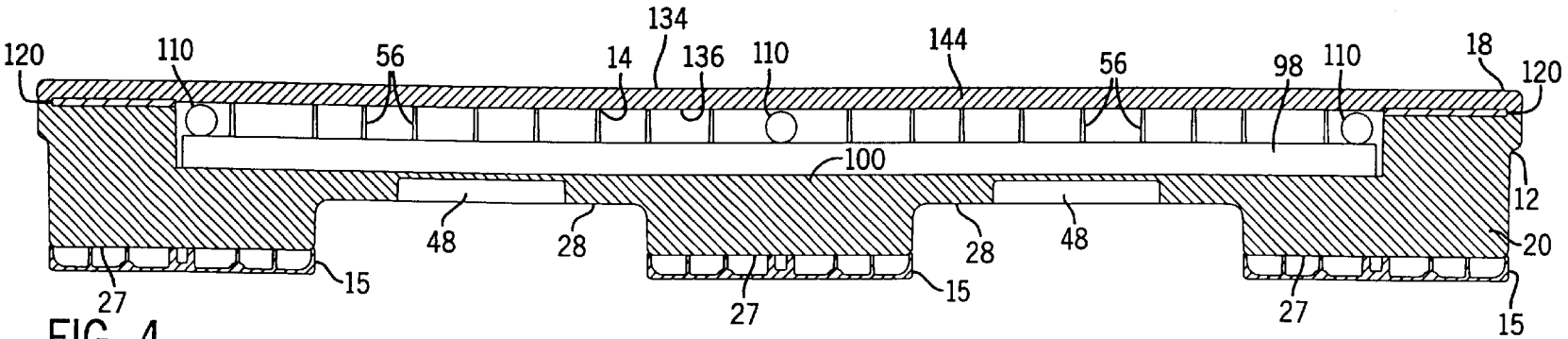
FIG. 4 is a cross sectional view along line 4—4 of FIG. 1.

As shown in FIGS. 3 and 4, the pallet lid 18 is joined to the deck top 14 forming an improved rackable pallet 10. Looking particularly at FIGS. 11–14, the lid 18 is substantially rectangular having a top 134, bottom 136, two opposing sides 138, two opposing ends 140, a longitudinal axis 148, and a lateral axis 150. Preferably, the lid 18 is formed using the same methods and materials as the pallet deck 12 with hollow channels 158, 159, 160, 161 formed therein to improve the lid strength.

Figure 11:
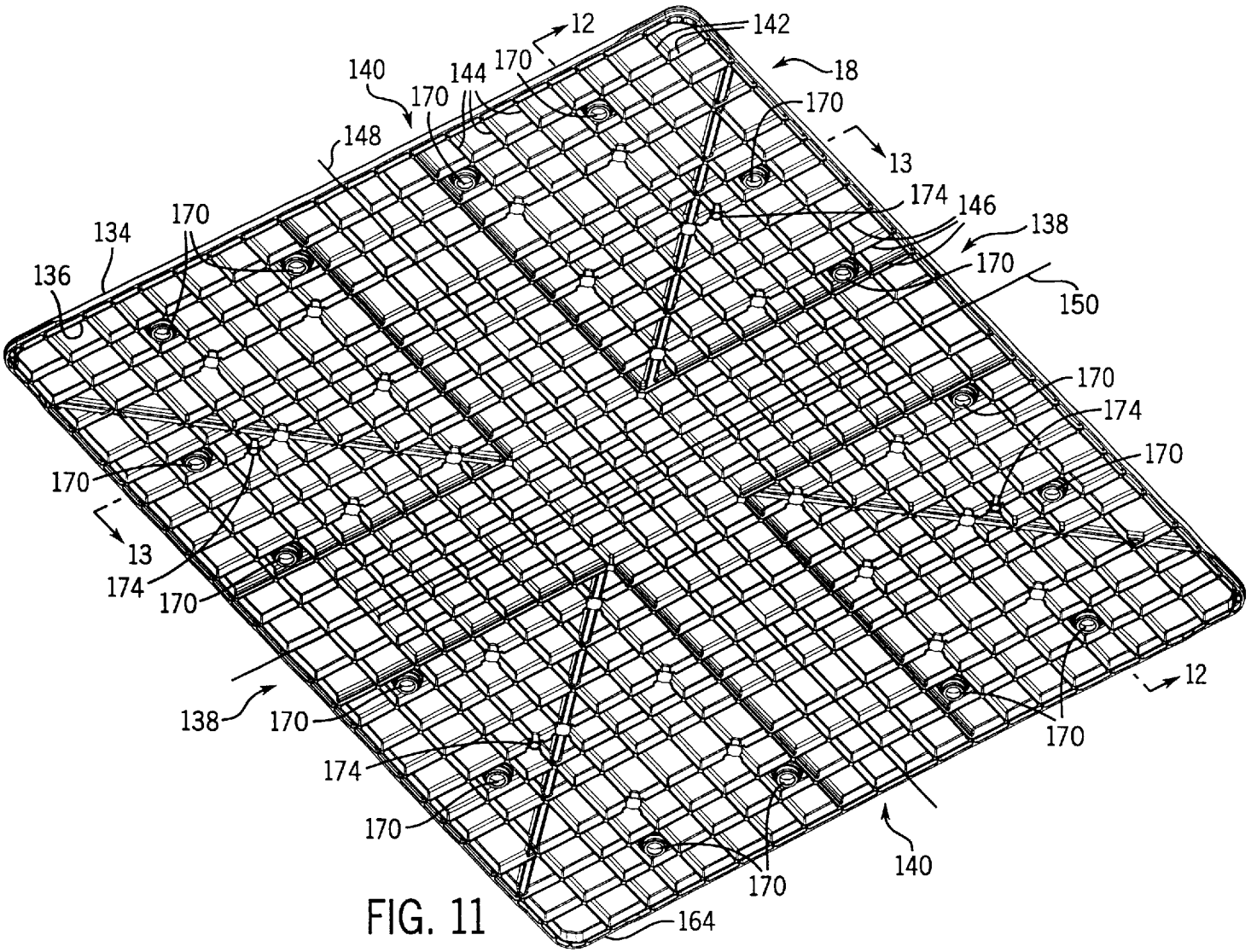
FIG. 11 is a bottom perspective view of the lid of FIG. 1.

Looking particularly at FIG. 11, the pallet lid 18 is a grid formed of a plurality of spaced ribs 144, 146 and surrounded by an edge rib 164 integrally formed around the grid 142 periphery. Preferably, the grid 142 is substantially identical to the deck grid 52 and formed by a set of twenty-one longitudinal ribs 144 which are substantially parallel to a lid longitudinal axis 148 and a set of twenty-six lateral ribs 146 perpendicular to the longitudinal ribs 144 and substantially parallel to a lid lateral axis 150. The lid axes 148, 150 divides the lid into four substantially identical quadrants. As in the deck 12, each lid quadrant has six gates 126 for injecting thermoplastic material into a mold defining the lid shape. One or more gates 126 are adapted to inject a gas into the thermoplastic material forming hollow channels 158, 159, 160, 161.

Figure 12:
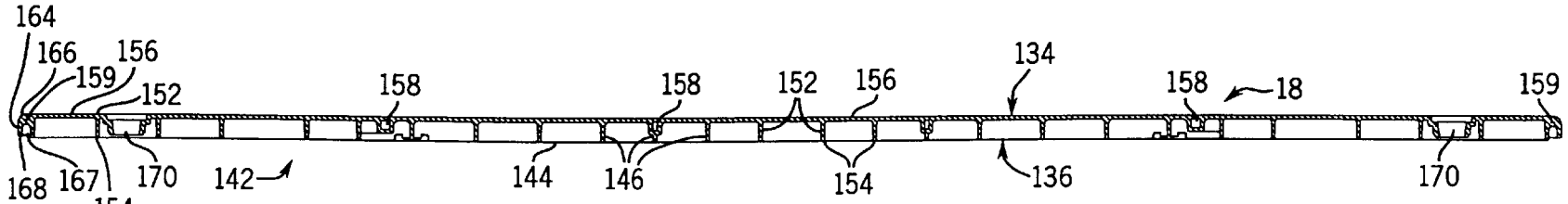
FIG. 12 is a cross sectional view along line 12—12 of FIG. 11.
Figure 13:
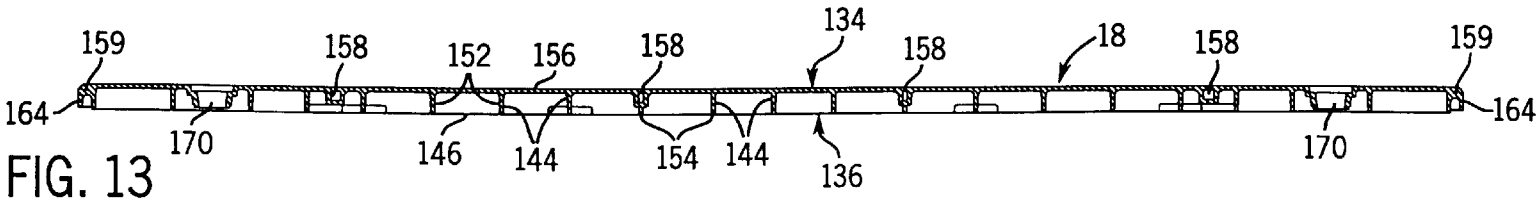
FIG. 13 is a cross sectional view along line 13—13 of FIG. 11.

Referring to FIGS. 12 and 13, the ribs 144, 146 are substantially narrower in width than in depth having upper edges 152 and lower edges 154. The upper edges 152 are substantially coplanar and are joined by a skin 156 defining the lid top 134. The rib lower edges 154 are substantially coplanar defining the lid bottom 136 and are preferably joined to the deck rib upper edges 62 to provide a rackable pallet 10 having an improved structural integrity.

Figure 14:
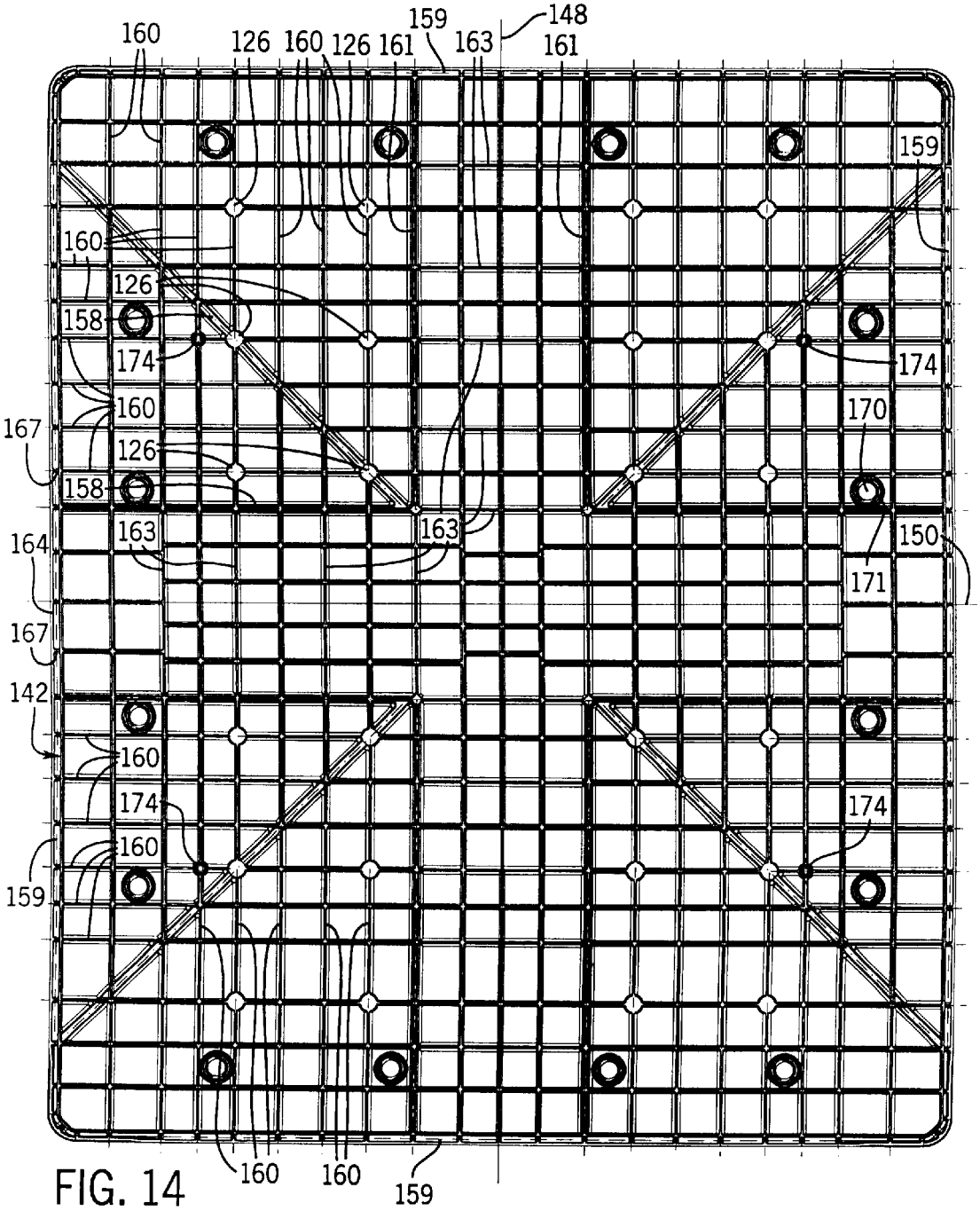
FIG. 14 is a bottom plan view of the lid of FIG. 11.
Figure 15:
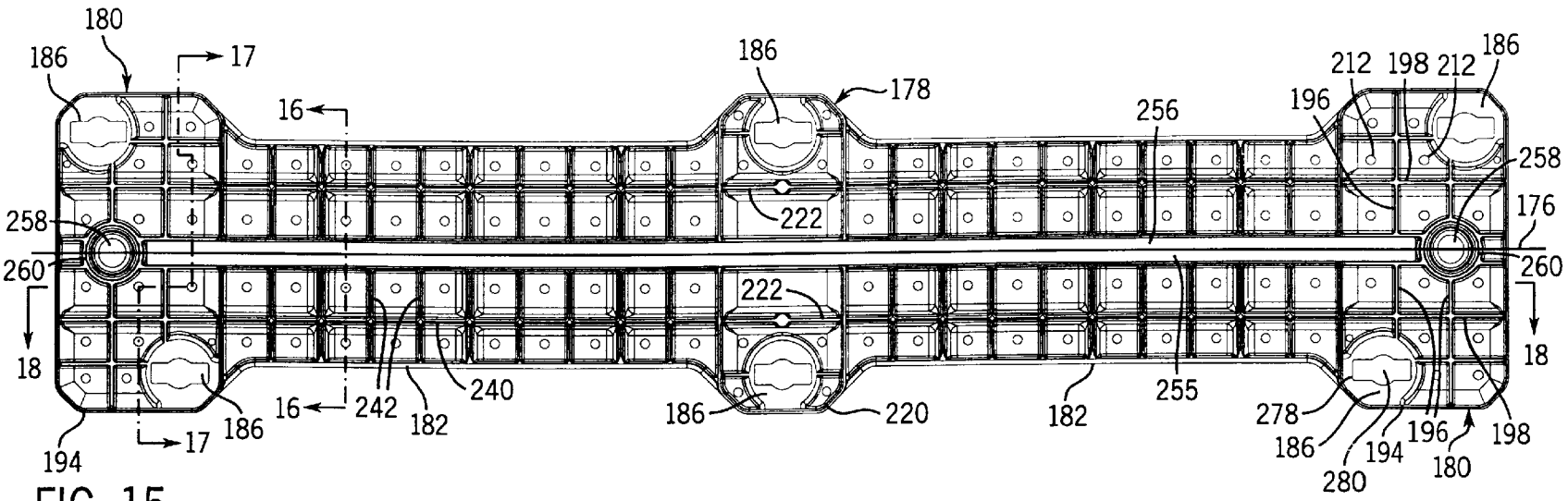
FIG. 15 is a top plan view of the foot strap of FIG. 1.
Figure 17:
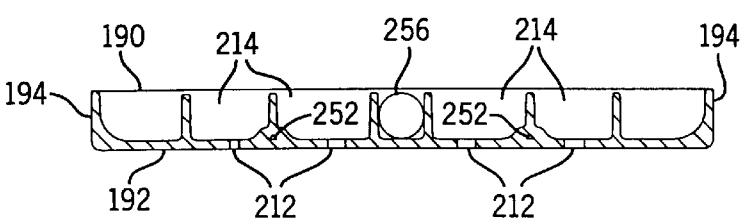
FIG. 17 is a cross sectional view along line 17—17 of FIG. 15.

Looking particularly at FIG. 14, hollow channels 158, 159, 160, 161 formed in the lid 18, increase the structural integrity of the lid 18 without increasing the lid weight. The channels 158, 159, 160, 161 form a pattern in lid quadrants defined by the longitudinal and lateral axes 148, 150, and surround the lid grid periphery. The hollow channels 158, 160 in the lid pattern are substantially identical to the primary channel 88, 90, 92 deck grid pattern 68, and the secondary channels 160 follow a similar pattern as the deck secondary channels 19. Hollow channel 161 is substantially aligned with the primary channel 17 along the deck fork support in the quadrant. The lid pattern channels 158, 160, however, extend to the grid periphery 157 in both the longitudinal and lateral directions intersecting with the edge hollow channels 159 surrounding the grid periphery. Secondary channels 163 also extend between quadrants connecting parallel primary channels 158, 161 in adjacent lid quadrants.

The lid grid 142 is surrounded by an edge rib 164 having upper and lower rib edges 166, 168 to provide an improved impact strength. The edge rib 164 is, spaced from the lid grid 142 periphery only a short distance forming a tubular edge bumper on the lid periphery. The edge rib upper edge 166 is substantially coplanar with the lid rib upper edges 152 and joined to the lid skin 156. The edge rib lower edge 168 is recessed from the lid rib lower edges 154 to minimize the formation of excess material 117 on the pallet exterior at the seam 120 between the deck 12 and lid 18 when they are joined together by hot plate welding (shown most clearly in FIG. 3). Short ribs 167 substantially perpendicular to the edge rib 164 define the space between the edge rib 164 and the lid grid 142 periphery. Preferably the lid edge rib 164 and short ribs 167 are aligned with and joined to the deck edge rib 116 and deck short ribs 124 to form a bumper surrounding the pallet periphery having an improved impact strength.

Holes 170 for securing an anti-skid rubber grommet 171 are formed in the lid top 134. Preferably, sixteen holes 170 are formed in the lid top, with four holes aligned substantially parallel to and spaced a distance from each lid side 138 and end 140. Grommets 171 secured in the holes 170 discourage a load from sliding off the lid top 134.

The lid 18 is joined to the deck 12 using methods known in the art such as bolting, adhesives, welding or the like. Preferably, the lid 18 is joined to the deck 12 by hot plate welding which butt welds the lid rib lower edges 154 to the deck rib upper edges 62 to provide a rackable pallet having an improved structural integrity. In one particular hot plate welding method, the lid rib lower edges 154 and edge bumper lower edges are heated on a Teflon® coated hot plate. The heated lid grid 142 and edge bumper 148 is then aligned with the deck grid and bumper to fuse the lid rib lower edges and deck rib upper edges together. Preferably, alignment pins 172 formed in the deck top 16 are received in corresponding alignment holes 174 formed in the lid bottom 136 to positively locate the lid 18 with respect to the deck 12 and ensure proper rib alignment. Advantageously, this particular method seals each grid cell 60 to create individually sealed compartments, so as prevent a liquid, such as water, from entering the pallet interior through one cell 60 and filling the entire pallet 10.

Figure 2:
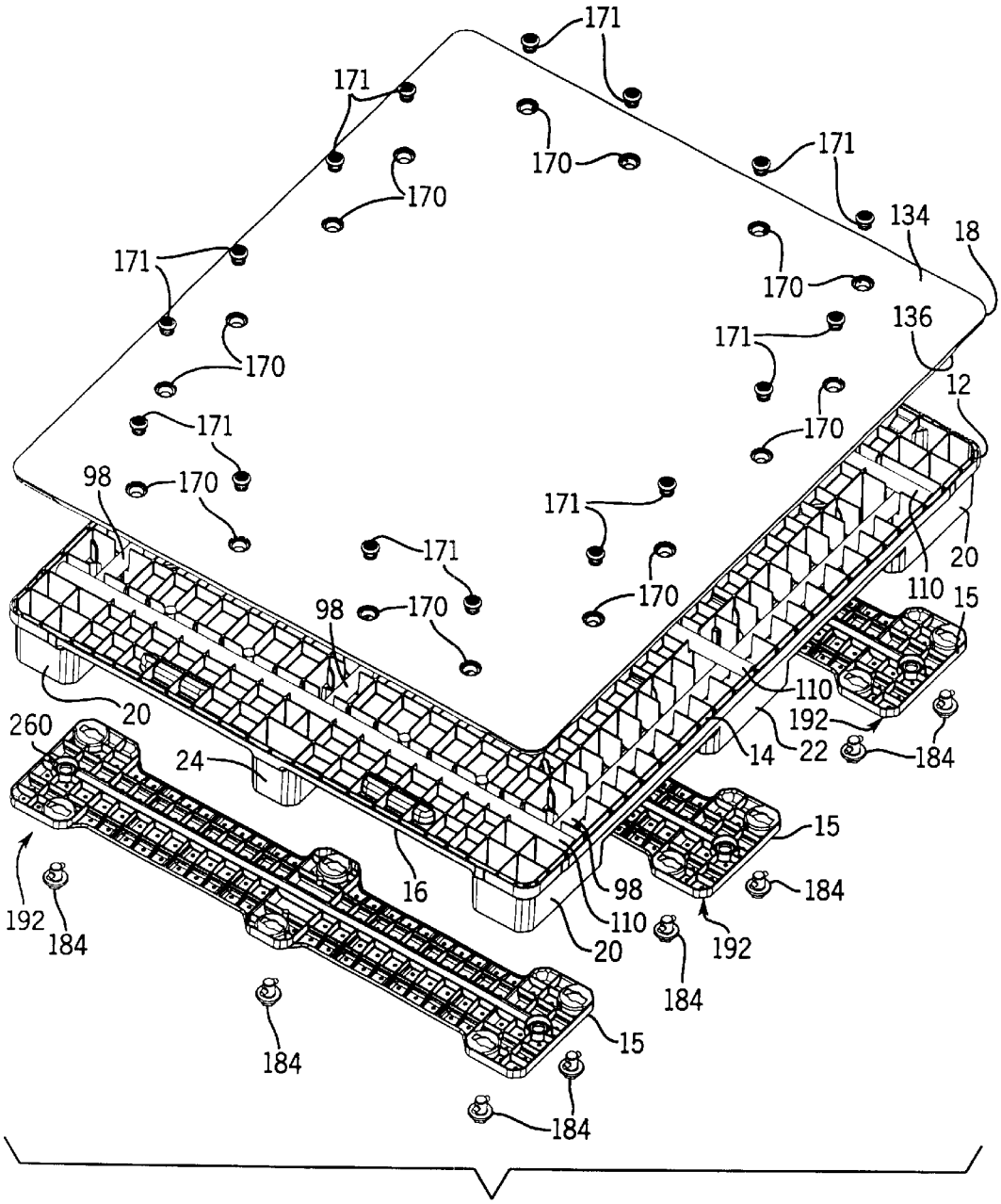
FIG. 2 is a top exploded perspective view of the pallet of FIG. 1.

Referring to FIG. 2, foot straps 15 mounted to the bottoms 27 of adjacent laterally aligned feet 20, 22, 24, 26 provide additional structural integrity to the pallet 10 and to minimize pallet deflection. Releasable fasteners 184 inserted through fastener cavities 186 formed in the foot extensions 178, 180 and retained in fastener receptacles 188 formed in the pallet feet bottoms 27 allow easy replacement in the event of foot strap 15 damage.

As shown in FIGS. 15–18, each foot strap 15 is bisected by a foot strap axis 176 extending along its length and has a center foot extension 178 joined to opposing end foot extensions 180 by stringers 182. Each end foot extension 180 is shaped substantially identical to the pallet feet bottom 27 having a top 190, bottom 192, and a perimeter wall 194 which defines the extension perimeter. A plurality of intersecting ribs 196, 198 on opposing sides of the foot strap axis 176 are substantially narrower in width than in depth having upper edges 200 and lower edges 202. The upper edges 200 are substantially coplanar and define the foot extension top 190. Preferably, the perimeter wall 194 extends above the foot extension top forming a ridge which surrounds the pallet foot 20. The rib lower edges 202 are substantially coplanar and joined to a skin 208 defining the foot extension bottom 210. A plurality of holes 212 formed in the extension bottom 210 provide drains for cells 214 formed by the ribs 196, 198 and perimeter wall 194.

The center foot extension 178 has a top 216, bottom 218, and a perimeter wall 220 which defines the center foot extension perimeter. A plurality of ribs 222 parallel to the foot strap axis 176 are substantially narrower in width than in depth having upper edges 224 and lower edges 228. The upper edges 224 are substantially coplanar and define the foot extension top 216. As in the end foot extension, preferably, the perimeter wall 220 extends above the foot extension top forming a ridge which surrounds the pallet foot. 24, 26. The rib lower edges 226 are substantially coplanar and joined to a skin 232 defining the foot extension bottom 218. As in the end foot extensions 180, holes 212 formed in the extension bottom 218 provide drains for cells 214 formed by the ribs 222 and perimeter wall 220.

Figure 16:
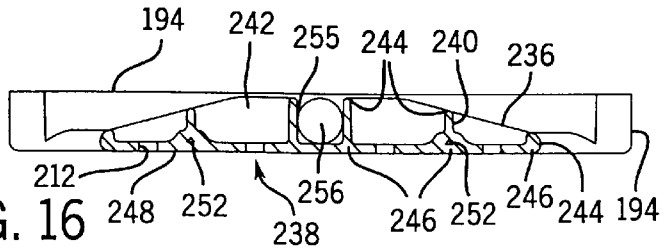
FIG. 16 is a cross sectional view along line 16—16 of FIG. 15.
Figure 18:
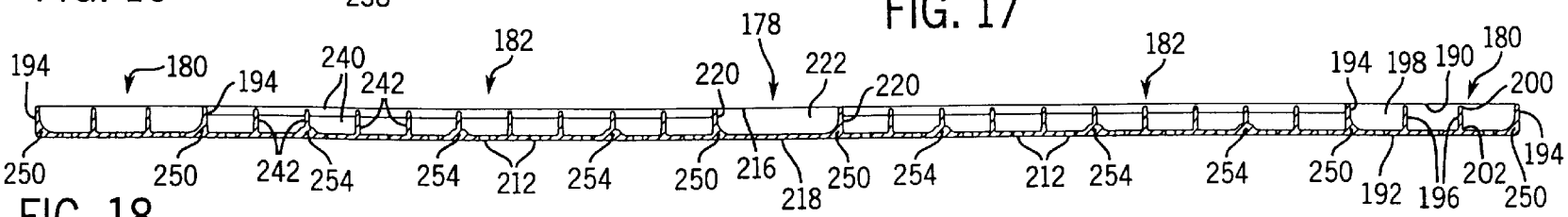
FIG. 18 is a cross sectional view along line 18—18 of FIG. 15.
Figure 19:
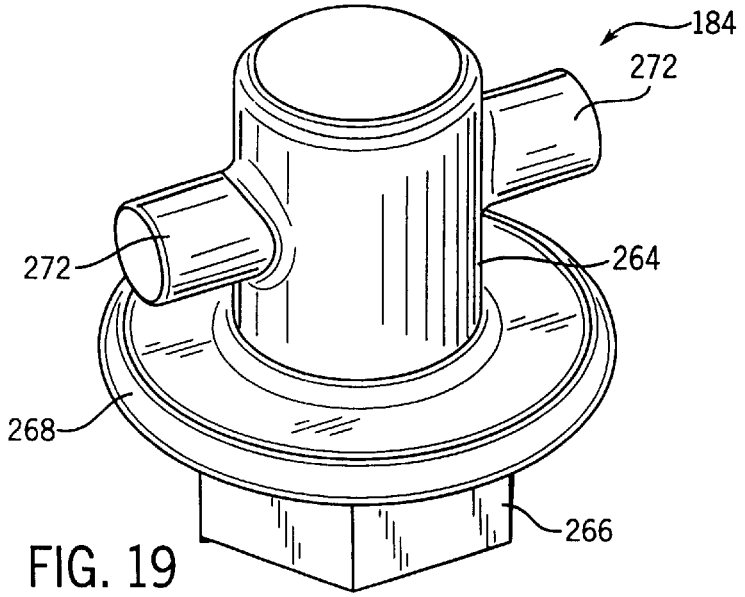
FIG. 19 is a top perspective view of the fastener of FIG. 1.
Figure 20:
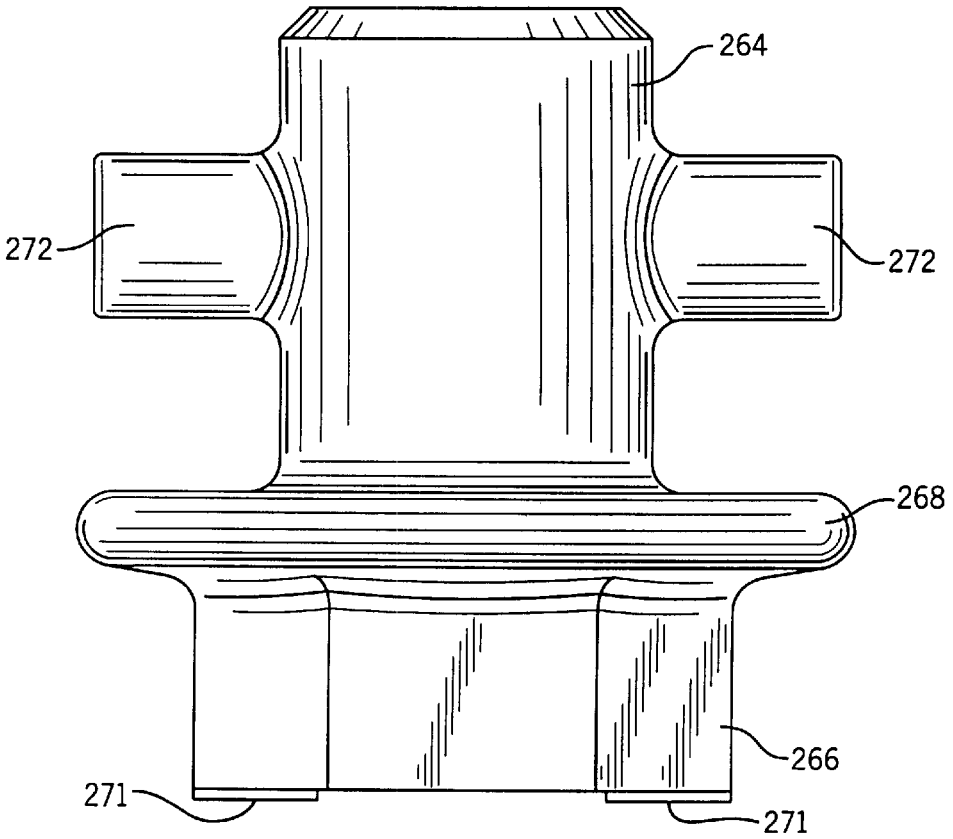
FIG. 20 is an elevational side view of the fastener of FIG. 19.
Figure 21:
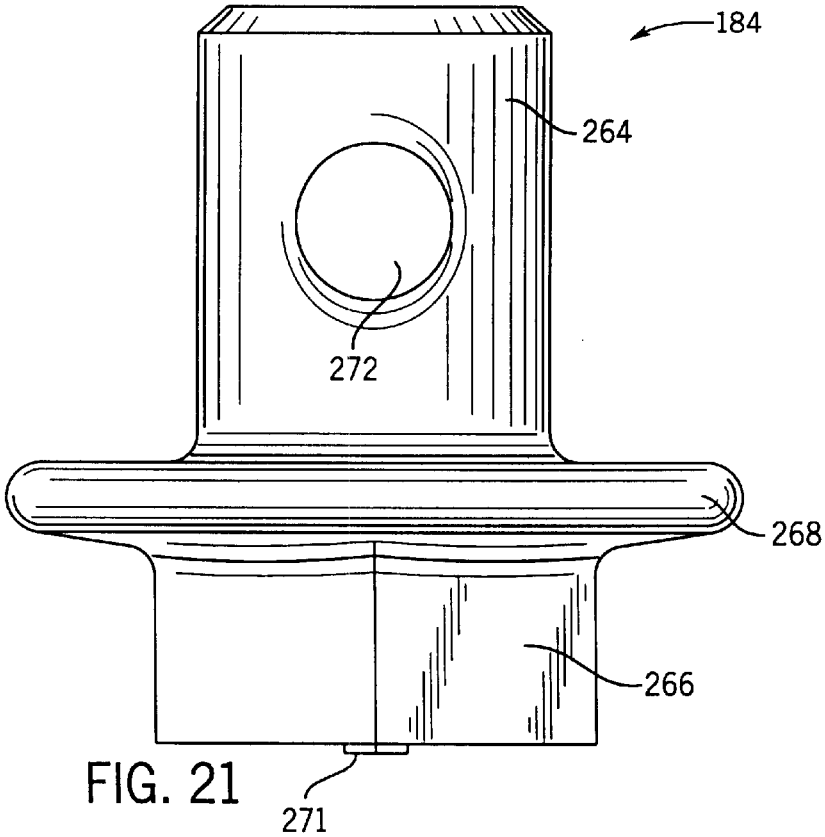
FIG. 21 is an elevational side view of the fastener of FIG. 20 rotated 90 degrees.
Figure 22:
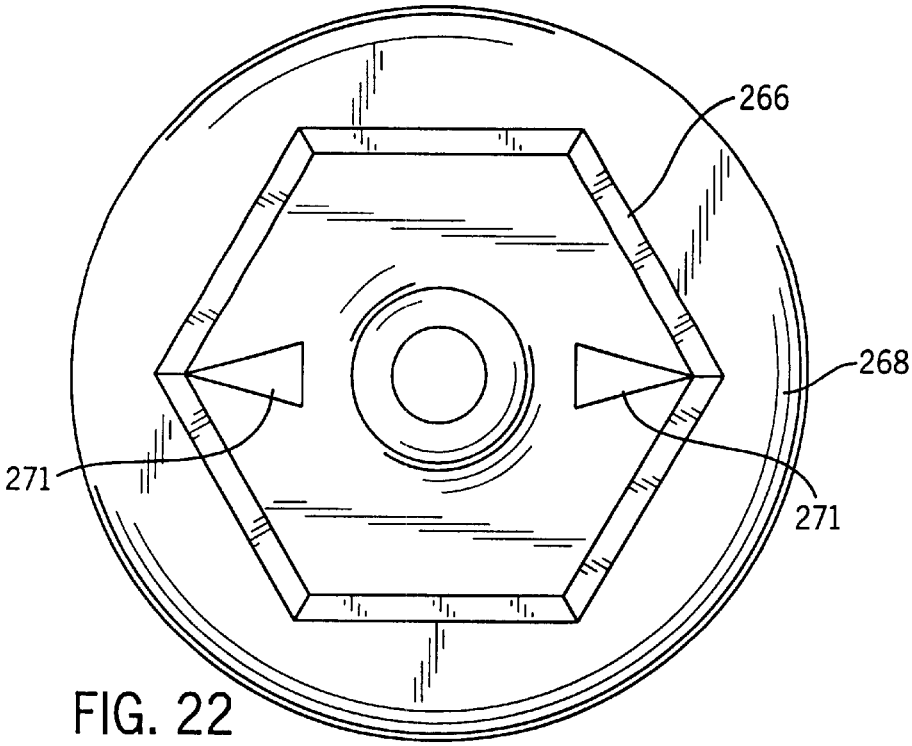
FIG. 22 is a bottom plan view of the fastener of FIG. 19.

Stringers 182 having a top 236 and bottom 238 join the end foot extensions 180 to the center foot extension 178. Each stringer 182 has a plurality of intersecting ribs 240, 242 on opposing sides of the foot strap axis 176. Looking particularly at FIGS. 5 and 7, the ribs 240, 242 have upper edges 244 and lower edges 246. As shown in FIG. 16, the upper edges 244 are progressively deeper as the ribs 240, 242 approach the foot strap axis 176 defining a dome-shaped top 236. The rib lower edges 246 are substantially coplanar and joined to a skin 248 which is substantially coplanar with the foot extension skins 208, 232 defining the stringer bottom 238. As in the foot extensions 178, 180, holes 212 formed in the stringer bottom 238 provide drains for cells 214 formed by the ribs 240, 242.

Preferably, the foot strap 15 is formed using the same methods and materials as the pallet deck 12 and lid 18 with hollow channels 250, 252, 254 formed therein to improve the foot strap strength. Preferably, hollow channels 250 are formed in each foot extension bottom 192, 218 along the perimeter wall 194, 220. Most preferably hollow channels 252 extending the length of the foot strap 15 on opposing sides of the strap axis 176 intersect a plurality of hollow channels 254 formed in the stringers 182 to further strengthen the foot strap 15.

A cavity 255 formed in the foot strap 15 coincident with the foot strap axis 176 receives a reinforcing member 256, such as steel tube, wood stiffener, composite stiffener, or the like. A grommet hole 258 for receiving an anti-skid grommet 260 is formed at opposing ends of the cavity 255 and defines the cavity ends.

Referring back to FIG. 2, the foot straps 15 are releasably attached to the pallet feet 20, 22, 24, 26 using shearable fasteners 184 to allow easy replacement and minimize foot strap damage. As shown in FIGS. 19–22, each fastener 184 has a cylindrical body 264 with a hex head 266, a pair of opposing, radially extending pegs 272 extending from the body which engage the fastener receptacle 188, and a flange 268 interposed between the head 266 and pegs 272. Orientation indicators 271 are formed on the hex head 266 to indicate the orientation of the pegs 272 when the body 264 is inserted into the fastener receptacle 188. Preferably, the fasteners 184 are formed from a shearable material, such as a brittle polycarbonate or the like, which allow the pegs 272 to shear off when excess force is applied to the foot strap 15 urging the separation of the foot strap 15 from the pallet 10. This shearing ability protects the pallet 10 and foot strap 15 from damage resulting from the excess force.

Figure 23:
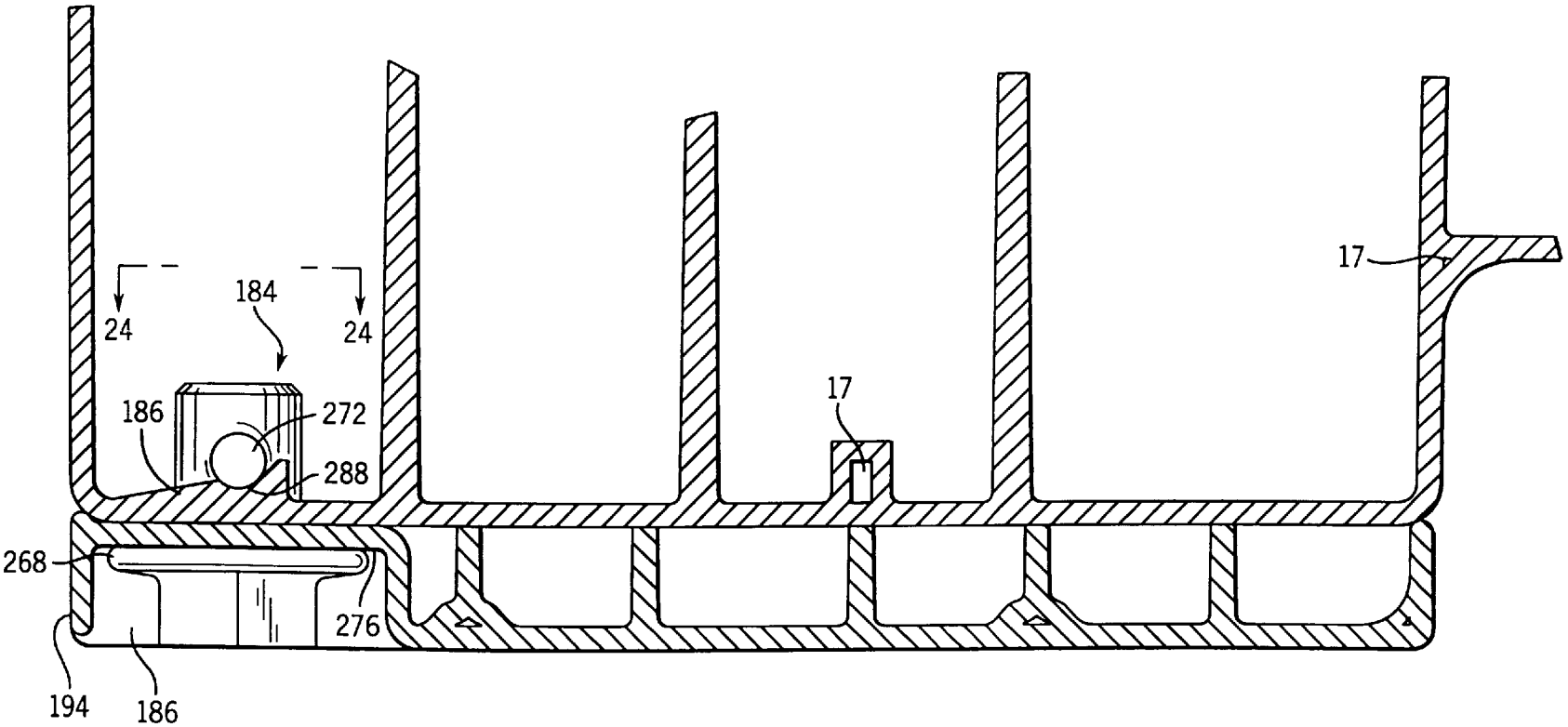
FIG. 23 is a cross sectional view along line 23—23 showing the fastener of FIG. 1.
Figure 24:
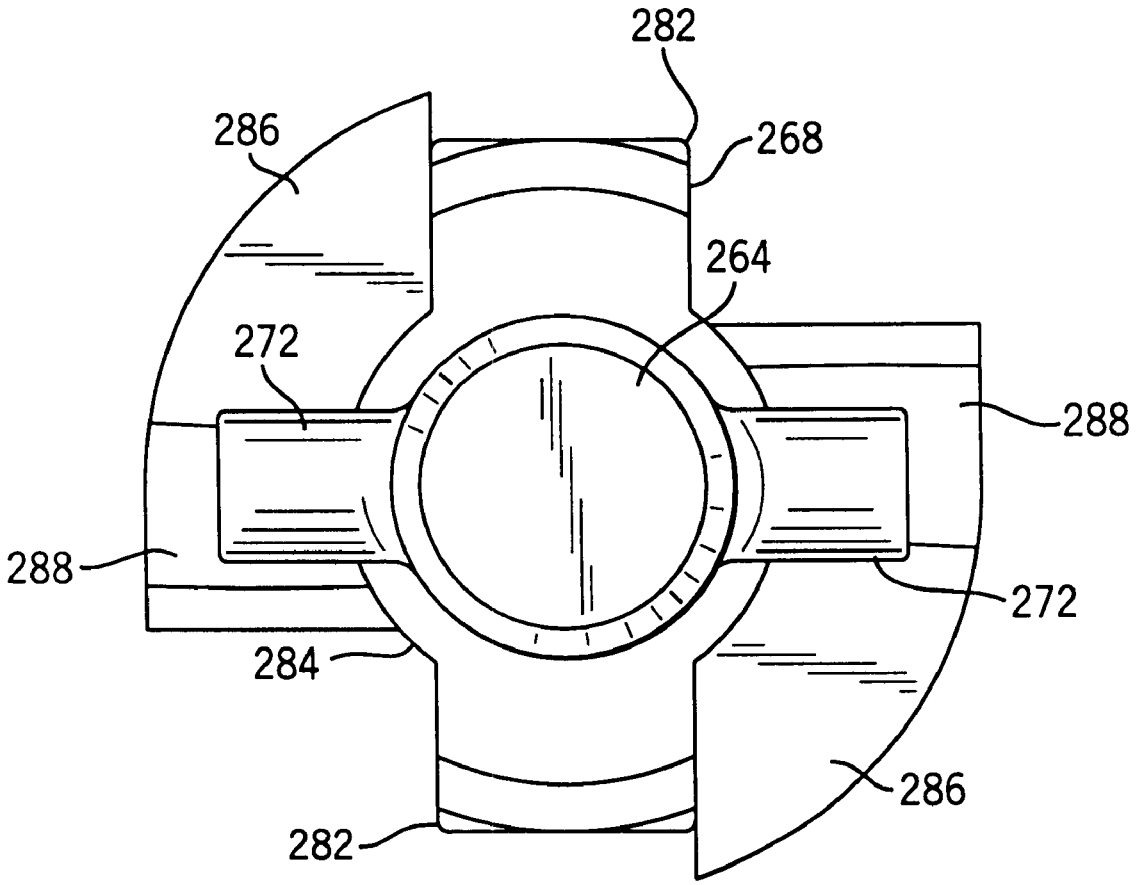
FIG. 24 is a sectional view along line 24—24 showing the fastener of FIG. 23.

As shown in FIGS. 23–24, each fastener 184 is inserted through the fastener cavity 186 formed in the foot extension 178, 180 and engages the corresponding fastener receptacle 188 to secure the foot strap 15 to the pallet 10. The downwardly facing fastener cavity 186 formed in the foot extension bottom 192 includes a cavity top 276 having a slot 278 with an enlarged center 280 formed therein for passing the body 264 and pegs 272 therethrough. The fastener flange 268 abuts the cavity top 276 to hold the foot strap 15 in place when the fastener 184 engages the fastener receptacle 188.

The fastener receptacle 188 includes a slot 282 with an enlarged center 284 formed in the foot bottom 27 for receiving the fastener body 264 and pegs 272. The fastener cavity slot center and fastener receptacle center are aligned to accommodate the fastener body inserted therethrough. Opposing ramps 286 formed inside the foot 20, 22, 24, 26 surrounding the receptacle slot 282 engage the pegs 272 and draw the fastener 184 tightly against the foot bottom 27 when the fastener 184 is rotated. Detents 288 formed at the uppermost end of each ramp 186 engage each peg 272 to hold the fastener in place. Preferably, the ramps 286 are adapted to require rotating the fastener 184 90° to engage the detents 288. Most preferably, the receptacle slot 282 is oriented 90° with respect to the fastener cavity slot 278 with aligned centers 280, 284 to prevent the fastener 184 from separating from the foot extension 178, 180 when the fastener 184 is disengaged from the receptacle 188.

The present invention provides a rackable molded pallet including: a deck having a grid defined by intersecting ribs with upper and lower edges; a plurality of feet supporting the deck; notches formed in the ribs defining an elongated recess in the grid; a reinforcing member received in the recess; and a lid joined to the deck enclosing the reinforcing member in the recess. The lid has a grid defined by intersecting ribs having upper and lower edges. The lid and deck are joined by joining the deck rib upper edges with the lid rib lower edges. Additional features of the present invention include, handles formed in fork supports and the deck bottom to facilitate manual lifting of the pallet, grommet holes and grommets to inhibit pallet load and pallet slippage, hollow channels formed in the deck, lid and feet to increase the structural integrity of the pallet without increasing the pallet weight.

The present invention also has a foot strap mounted to the deck feet to improve the structural integrity of the pallet. The foot strap is mounted to the feet with releasable shearable fasteners to simplify foot strap replacement and minimize foot strap damage.

While there has been shown and described a preferred embodiment of the invention, it will be obvious to those skilled in the art that various changes and modifications can be made therein without departing from the spirit of the invention.

I claim:

1. A molded conveying platform, comprising:

a deck formed of a plurality of spaced ribs having upper and lower edges, wherein said rib upper edges define a deck top and said lower edges define a deck bottom;

notches having opposing side edges and a bottom edge formed in ribs of said deck as to define an elongated cavity in said deck top;

a reinforcing member disposed in said cavity between said notch side edges and supported by said notch bottom edge for strengthening said deck; and a lid joined to said deck top enclosing said reinforcing member in said cavity.

2. A molded conveying platform as in claim 1, including hollow channels formed in said deck for strengthening said deck.

3. A molded conveying platform as in claim 2, in which said hollow channels are formed along the deck rib lower edges and define a pattern to strengthen specific areas of said deck.

4. A molded conveying platform as in claim 3, in which said pattern is substantially identical in each of four pallet quadrants defined by a longitudinal and lateral axis.

5. A molded conveying platform as in claim 2, including feet formed as an integral part of said deck, in which said hollow channels extend downwardly into said feet to form columns for supporting said reinforcing member.

6. A molded conveying platform as in claim 1, including a second reinforcing member which overlaps said first reinforcing member to further strengthen said deck.

7. A molded conveying platform as in claim 6, in which said first reinforcing member is substantially parallel to a conveying platform longitudinal axis, and said second reinforcing member is substantially parallel to a conveying platform lateral axis.

8. The molded conveying platform as in claim 1, including hollow channels formed in said lid to strengthen said lid.

9. A molded conveying platform as in claim 8, in which said hollow channels formed along the lid rib upper edges and define a pattern to strengthen specific areas of said lid.

10. A molded conveying platform as in claim 9, in which said pattern is substantially identical in each of four pallet quadrants defined by a longitudinal and lateral axis.

11. A molded conveying platform as in claim 1, including a bumper surrounding said platform.

12. A molded conveying platform as in claim 1, including an indentation for use as a handle formed in said deck bottom proximal a perimeter of said deck.

13. A molded conveying platform as in claim 1, including a plurality of feet having bottoms extending downwardly from said deck bottom, in which two or more of said plurality of feet are in an aligned arrangement, and a foot strap is releasably attached to said bottoms of said aligned feet.

14. A foot strap suitable for releasably attaching to feet of a conveying platform, comprising:

a plurality of foot extensions, each of said foot extensions having a perimeter wall formed to surround a pallet foot;

a fastener cavity formed in at least one of said foot extensions for receiving a releasable fastener to attach said foot strap to the platform;

a stringer joining adjacent foot extensions, said stringer having intersecting ribs with upper and lower edges, said upper edges defining a stringer top, and said lower edges defining a stringer bottom; and notches having opposing side edges and a bottom edge formed in ribs of said stringer so as to define a cavity in said stringer for receiving a reinforcing member in said cavity between said opposing notch side edges and supported by said notch bottom edge to strengthen said foot strap.

15. A foot strap as in claim 14, wherein said fastener cavity has a top with a slot including an enlarged center for receiving a fastener.

16. A foot strap as in claim 15, in which said slot is oriented substantially 90° from a fastener receptacle slot formed in said foot bottom.

17. A foot strap as in claim 14, in which said ribs are progressively deeper as said ribs approach said foot strap axis.

18. A foot strap as in claim 14, in which said cavity extends along a foot strap axis bisecting said foot strap.

19. A foot strap as in claim 14, including hollow channels formed therein to strengthen said foot strap.

* * * * *